US006744439B1

(12) United States Patent
Laury et al.

(10) Patent No.: US 6,744,439 B1
(45) Date of Patent: Jun. 1, 2004

(54) RECONFIGURABLE COLOR CONVERTER

(75) Inventors: Marc Laury, Grenoble (FR); Franck Seigneret, Rives (FR); Emmanuel Chiaruzzi, Grenoble (FR); Philippe Monnier, Villard Bonnot (FR)

(73) Assignee: STMicroelectronics S.A., Gentilly (FR)

( * ) Notice: Subject to any disclaimer, the term of this patent is extended or adjusted under 35 U.S.C. 154(b) by 486 days.

(21) Appl. No.: 09/695,753

(22) Filed: Oct. 24, 2000

(30) Foreign Application Priority Data

Oct. 25, 1999 (FR) ..... 99/13544

(51) Int. Cl.[7] ..... G09G 5/37

(52) U.S. Cl. ..... 345/562; 345/572; 345/600; 345/605

(58) Field of Search ..... 345/592, 600, 345/601, 602, 603, 604, 605, 561, 562, 572

(56) References Cited

U.S. PATENT DOCUMENTS 4,791,580 A 12/1988 Sherrill et al. ..... 364/521
5,204,664 A * 4/1993 Hamakawa ..... 345/602
5,406,310 A * 4/1995 Aschenbrenner et al. ... 345/602
5,636,335 A * 6/1997 Robertson et al. ..... 345/602
5,745,104 A * 4/1998 Minoura ..... 345/601
6,088,050 A * 7/2000 Ng ..... 347/237
6,307,559 B1 * 10/2001 Hancock et al. ..... 345/619

* cited by examiner

*Primary Examiner*—Ulka J. Chauhan
(74) *Attorney, Agent, or Firm*—Lisa K. Jorgenson; Robert Iannucci; Seed IP Law Group PLLC

(57) ABSTRACT

A digital image processing circuit for replacing an input code associated with a pixel of the image with an output code selected in a first memory containing a set of codes, including an input bus for receiving the input code, an output bus for providing the output code, said first memory, means of address calculation of the first memory, means of address selection of the first memory between the input code and an address code generated by the address calculation means, a second memory for containing an address code generated by the address calculation means, and means of selection of the output code between a code read from the first memory and said code contained in the second memory.

20 Claims, 7 Drawing Sheets

RECONFIGURABLE COLOR CONVERTER

BACKGROUND OF THE INVENTION

1. Field of the Invention

The present invention relates to digital image processing circuits, and in particular to a circuit enabling modification of the coding of the colors associated with the pixels of a digital image.

2. Discussion of the Related Art

A digital image is conventionally formed of pixel rows and columns. Each image pixel is especially associated with a color. A common type of coding is the so-called RGB coding, in which the colors are represented by three components: red (R), green (G), and blue (B), each of which is conventionally coded over a same number of bits. In such a coding, the number of bits used for the R, G, B components determines the number of possible colors for each image pixel. For example, R, G, and B components coded over 8 bits enable describing $2^{3\times8}$, that is, more than 16 million different colors. It should be noted that all the pixels of a same image are conventionally coded with a same number of bits. A component A corresponding to a transparency information is sometimes added to the three R, G, and B components.

In certain applications, it may be desired to reduce the number of bits used to code the colors of the pixels of a digital image. Indeed, the more the colors of the pixels of an image are coded over a large number of bits, the more this image represents a great amount of information. Reducing the number of color coding bits enables reducing the amount of information represented by an image, which enables storing the image in a reduced memory space, processing it faster, or transmitting it, for example with a modem, in a shorter time.

A known solution to reduce the number of bits coding an image consists of creating a color look-up table (CLUT) containing a restricted number of colors coded like the original colors of the image pixels. The RGB coding of the original color of each pixel is then replaced with a CLUT code corresponding to an address of a color of the color look-up table, which is the closest to the original pixel color. The number of colors in the look-up table being reduced, the coding of its addresses may include a reduced number of bits as compared to that used in the RGB coding of the original colors. Thus, the CLUT code of a color can have a reduced number of bits with respect to the number of bits of an RGB code. For example, an address coded over eight bits enables completely addressing a look-up table of $2^8$ =256 colors. Considering the preceding example, and having a look-up table of 256 colors, each of which is RGB-coded over 24 bits, the 24-bit RGB code of the original color of each pixel can be replaced with an 8-bit color look-up table address. Such a substitution enables substantially reducing (approximately by three in this example) the amount of information represented by an image.

In a digital image processing device, previously described complete (RGB type) and reduced (CLUT type) color codings are used. For example, an image may be created with a complete color coding, then be transformed to have a reduced color coding, which enables transmitting it rapidly by modem or retouching it by means of a software. Finally, such an image may be transformed back to recover a complete color coding, which for example enables displaying it on a computer screen. Some digital image processing devices are intended for receiving several images and assembling them in a single image. As an example, a blitter circuit, conventionally used to create an image based on several images of various origins, will be considered hereafter.

FIG. 1 schematically shows, in the form of blocks, an example of an image processing device 2, for example a computer graphics board. Device 2 includes a memory 4 in which are stored several digital images that can have different complete or reduced color codings. Memory 4 (MEM) is connected to a bus 6 to receive write and read control signals and to provide or receive data. A central processing unit (CPU) 8 is connected to bus 6 to receive or provide data or control signals. Device 2 also includes a blitter 9 provided with a calculation circuit 10 (BLITTER CORE) and with two intermediary or buffer memories (BUF1) 12 and (BUF2) 14. Circuit 10 includes a first and a second image inputs respectively connected through intermediary memories 12 and 14 to receive data from bus 6. Circuit 10 includes a data output that forms the output of blitter 9. This output is connected through an intermediary memory or buffer (BUF3) 16 to a display device (DISP) 18. Intermediary memory 16 is also connected to bus 6 to receive control signals or data from the central processing unit and provide data thereto.

Conventionally, blitter core 10 of blitter 9 is provided to process images having a given color coding, for example a CLUT coding. Images having a different color coding, in this example, an RGB coding or the like, must be converted to have the CLUT coding before they can be provided to blitter core 10. Thus, images having a color coding that is not readily usable by the blitter core are read from memory 4 by central processing unit 8 that converts their coding, then controls their writing into one of intermediary memories 12 or 14 of blitter 9. When both intermediary memories 12 and 14 contain images having a color coding usable by blitter core 10, circuit 10 reads their respective contents and generates an image that it provides to intermediary memory 16. It should be noted that the images generated by circuit 10 may be in a code that is not readily usable by display device 18. In such a case, the image contained in intermediary memory 16 will have to be read and its color coding will have to be converted by processor 8 before it can be provided to display device 18 via intermediary memory 16.

In such an operation, the central processing unit must frequently be used to convert images to the format accepted by the blitter core. Such a use of the CPU does not enable using it for other tasks, which adversely affects the performance of the system in which circuit 10 is integrated, for example a microcomputer.

The only solution to increase the system performance consists of using a faster CPU, but such a solution is expensive.

SUMMARY OF THE INVENTION

The present invention aims at overcoming the disadvantages of known blitters.

An embodiment of the present invention provides a digital image processing circuit enabling saving CPU processing time of the system in which it is integrated.

The image processing circuit includes a circuit having a color coding conversion function and an image composition function.

The image processing circuit provides a particularly low-cost solution.

The image processing circuit is adapted to replace an input code associated with a pixel of the image with an output code selected in first storage means containing a set of codes, which includes an input bus adapted to receive the input code, an output bus adapted to provide the output code, said first storage means, means of address calculation of the first storage means, means of address selection of the first storage means between the input code and an address code generated by the address calculation means, second storage means adapted to contain an address code generated by the address calculation means, and means of selection of the output code between a code read at the current address of the first storage means and said code contained in the second storage means.

According to an embodiment of the present invention, the address calculation means include an address generator adapted to provide predetermined address codes to the addressing means, and a data comparison circuit provided to compare the first code with the codes stored at the predetermined addresses in the first storage means, to determine which of the compared codes is closest to the first code, and to control the second storage means to store the code of the address at which the closest compared code is stored in the first storage means.

According to an embodiment of the present invention, the input and output buses each include first, second, third, and fourth sub-buses each having a same number of bits, the address selection means include first, second, third, and fourth multiplexers, the first inputs of which are respectively connected to the first, second, third, and fourth input sub-buses, the output of the first multiplexer being connected to the second inputs of the second, third, and fourth multiplexers, the first storage means include a first, a second, a third, and a fourth identical memory circuits, the addressing inputs of which are respectively connected to the outputs of the first, second, third, and fourth multiplexers, and the output code selection means include a fifth multiplexer, the first input of which is connected to the data output of the first memory circuit and the output of which is connected to the first output sub-bus, the second, third, and fourth sub-buses being respectively connected to the data outputs of the second, third, and fourth memory circuits.

According to an embodiment of the present invention, the address generator is formed with a counter adapted to providing a predetermined series of address codes to the second input of the first multiplexer, and the data comparison circuit includes: a calculator connected for respectively receiving the codes provided to the first three input sub-buses and the codes provided by the first three memory circuits, and provided to provide a digital signal equal to the difference between these codes, and a memory comparator connected for keeping the smallest difference digital signal calculated for the predetermined series of address codes and for controlling the second storage means to store the code of the address at which the codes corresponding to the smallest difference are stored in the first storage means.

The present invention also provides a method of image processing by means of a digital image processing circuit according to one of the preceding embodiments, which consists of receiving images, the color codes of which each correspond to an address in a color reference table, and replacing each address with the color code designated by this address in the reference table.

According to an embodiment of the present invention, the method includes receiving images, the colors of which are coded in a predetermined way, and of replacing the code of each color of the image with an address in a color reference table.

According to an embodiment of the present invention, the method includes the steps of storing, in the first, second, third, and fourth memory circuits, respective red, green, and blue color and transparency codes, providing a respective red, green, and blue color and transparency code to the first, second, third, and fourth input sub-buses, and controlling the multiplexers of the address selection means and of the output selection means to provide the first, second, third, and fourth memory circuits with the codes received on the first, second, third, and fourth input sub-buses, and to provide the four output sub-buses with the respective codes provided by the four memory circuits.

According to an embodiment of the present invention, the method includes the steps of storing, in the first, second, third, and fourth memory circuits, respective red, green, and blue color and transparency codes, providing an address code to the first input sub-bus, and controlling the multiplexers of the address selection means and of the output selections means to provide the first, second, third, and fourth memory circuits with the code received on the first input sub-bus, and to provide the four output sub-buses with the respective codes provided by the four memory circuits.

According to an embodiment of the present invention, the method includes the steps of storing in the first, second, third, and fourth memory circuits respective red, green, and blue color and transparency codes, providing an address code to the first input sub-bus, providing a transparency code to the fourth input sub-bus, and controlling the multiplexers of the address selection means and of the output selection means to provide the first, second, and third memory circuits with the code received on the first input sub-bus, to provide the fourth memory circuit with the code received on the fourth input sub-bus, and to provide the four output sub-buses with the respective codes provided by the four memory circuits.

According to an embodiment of the present invention, the method includes the steps of storing in the first, second, third, and fourth memory circuits respective red, green, and blue color and transparency codes, providing the first, second, and third input sub-buses with respective red, green, and blue color codes, activating the counter, and controlling the multiplexers of the address selection means and of the output selection means to provide the first three memory circuits with the address codes provided by the counter, and to provide the first output sub-bus with the address code provided by the second storage means.

The foregoing objects, features and advantages of the present invention, will be discussed in detail in the following non-limiting description of specific embodiments in connection with the accompanying drawings.

DETAILED DESCRIPTION

The same elements have been designated by the same references in the different drawings. For clarity, only those elements that are necessary to the understanding of the present invention have been shown. In particular, the details constitutive of the blitter core have not been specified and are no object of the present invention. Further, the blitter of the present invention will only be described for its components that differ from the conventional circuit.

Figure 1:
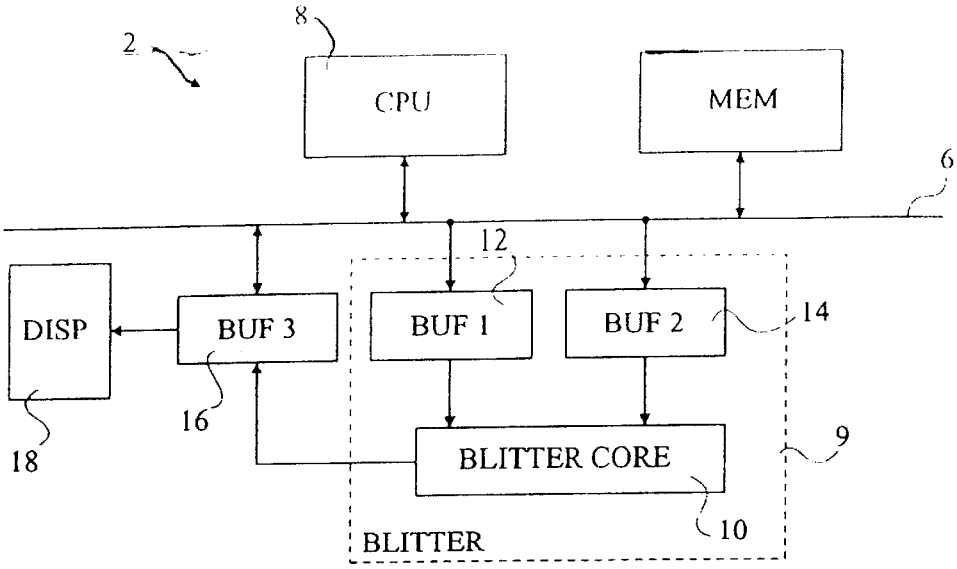
Fig 1 (Prior Art)
FIG. 1, previously described, schematically shows a conventional digital image processing device.
Figure 2:
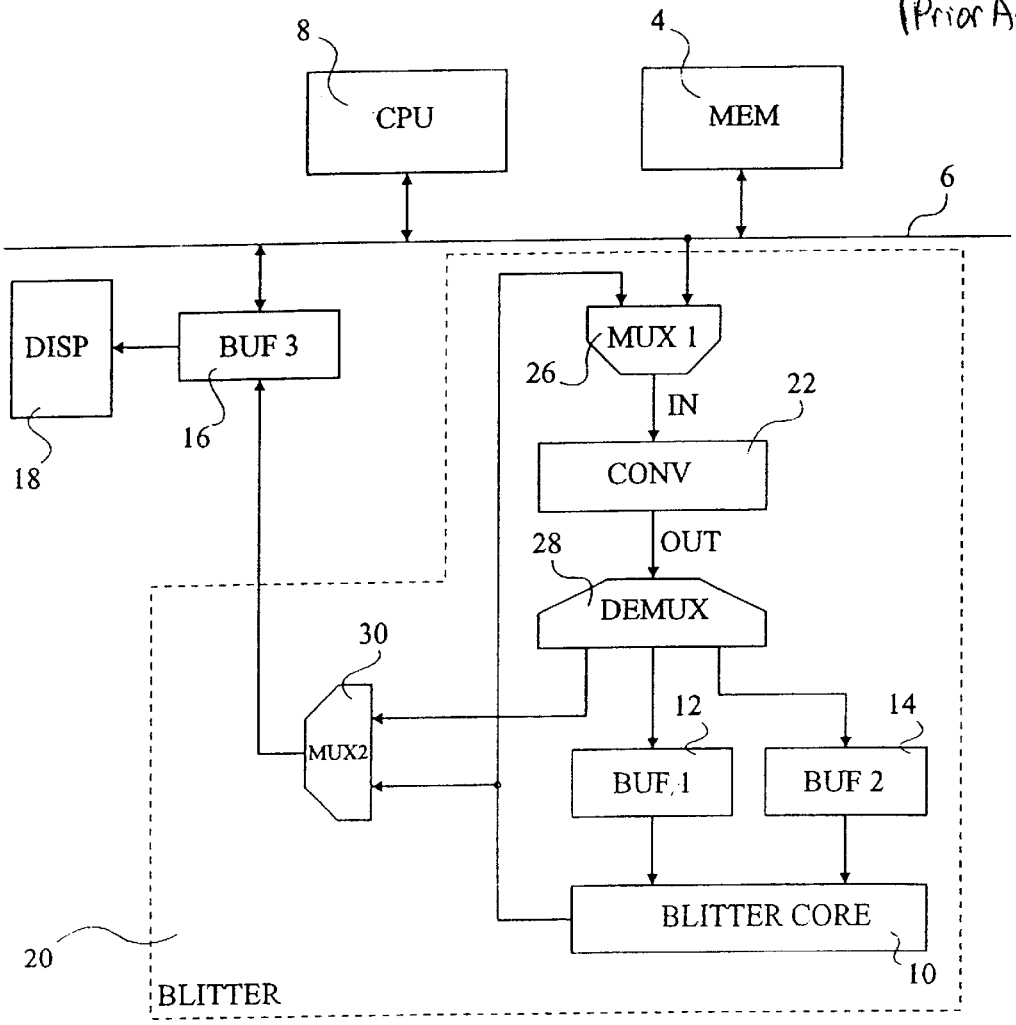
FIG. 2 schematically shows a digital image processing device including a blitter according to an embodiment of the present invention.

FIG. 2 shows an image processing device such as that in FIG. 1, including a blitter 20 according to an embodiment of the present invention. In the example of FIG. 2, the processing device includes, as previously, a CPU 8, a memory (MEM) 4, a bus 6, a display device (DISP) 18, and an intermediary memory (BUF3) 16. Circuit 20 also includes a conventional blitter core 10, the two inputs of which are connected to the outputs of two intermediary memories (BUF1) 12 and (BUF2) 14.

The blitter 20 includes a color converter (CONV) 22 connected to convert the color codings of the images provided to intermediary memories 12 and 14, and those of the images provided by circuit 10. Thus, the input (IN) of converter 22 is connected to an input multiplexer (MUX1) 26 to receive data from bus 6 or from the output of blitter core 10, and the output (OUT) of converter 22 is connected to a demultiplexer (DEMUX) 28 to provide data to one or the other of intermediary memories 12 and 14, or to a first input of an output multiplexer (MUX2) 30. A second input of multiplexer 30 is connected to the output of blitter core 10 and its output is connected to the input of intermediary memory 16. It should be noted that the output of circuit 10 could, in another embodiment, be connected to bus 6 to directly write into memory 4. Branching elements such as multiplexers 26 and 30 and demultiplexer 28, converter 22, and blitter core 10 are all connected to be controlled by CPU 8. The necessary control connections, as well as their management, are conventional and will not be detailed any further. So connected, converter 22 has the function of modifying the coding of the colors of the images provided to blitter core 10 or by blitter core 10. Thus, the color codings of the images intended for the first and second inputs of circuit 10 can be modified by converter 22 before these images are stored in intermediary memories 12 and 14. Similarly, the color coding of an image generated by the blitter core can be modified so that this image is directly usable by display circuit 18. In the present example, this image is stored in intermediary memory 16.

It should be noted that branching elements 26, 28, and 30 enable forming an economical circuit that uses a single converter 22 to convert the format of the images written into intermediary memories 12, 14 and 16. As an alternative, three distinct conversion circuits may be used, which is more expensive but enables obtaining a greater processing speed.

Figure 3:
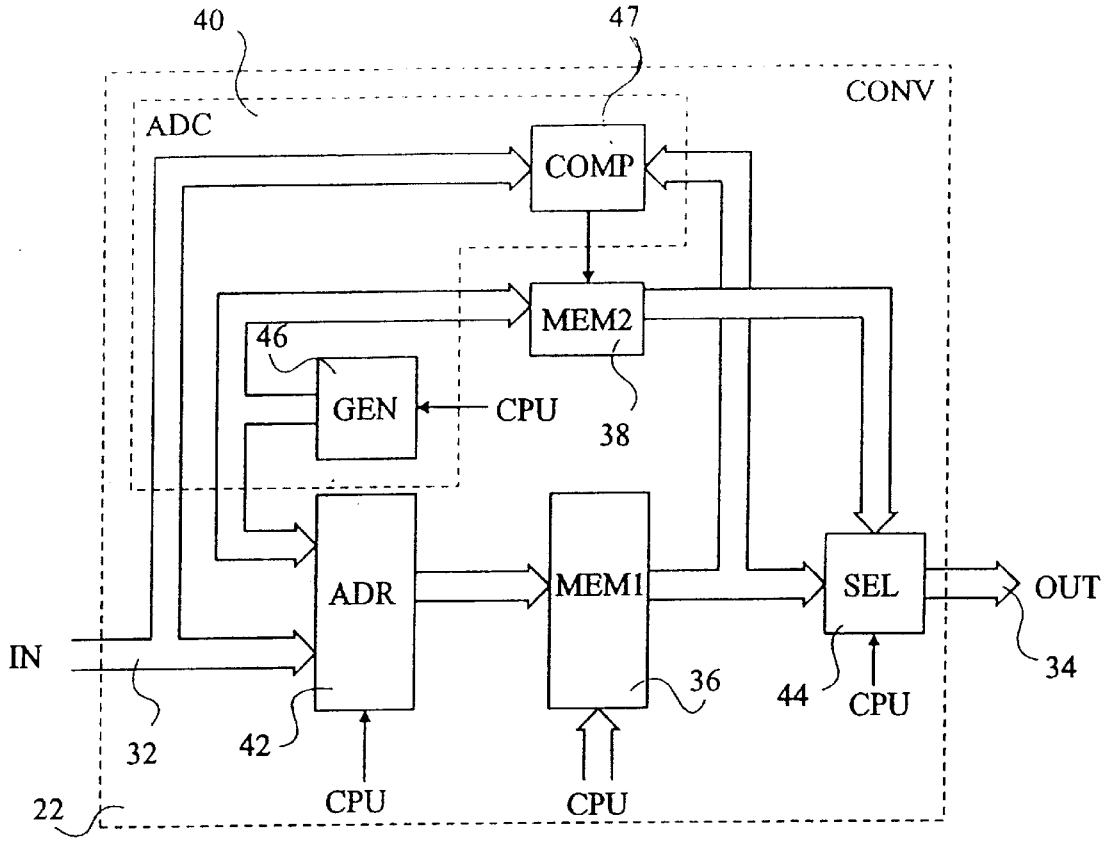
FIG. 3 schematically shows in the form of blocks an embodiment of a color converter of the blitter according to the present invention.

FIG. 3 shows an embodiment of color converter 22 of FIG. 2. This circuit includes an input bus (IN) 32 adapted to receive an input code, which is the coding of the color of a pixel of an input image, and an output bus (OUT) 34 adapted to provide an output code, which is the coding of the color of the same pixel of an output image. Circuit 22 also includes a memory or first storage means (MEM1) 36 storing a predetermined number of output codes, which form a color reference table, for example, a color look-up table, a second memory or storage means (MEM2) 38, the function of which will be explained hereafter, an address calculator (ADC) 40, connected to receive the input code and the codes provided by memory 36. Address calculator 40 is further connected to provide an address code and a write order to memory 38. Conversion circuit 22 also includes an address selector (ADR) 42 connected to provide memory 36 with an address code received either from input bus 32, or from address calculator 40. Circuit 22 further includes an output code selector (SEL) 44 provided to provide output bus 34 with an output code corresponding either to the codes provided by memory 36, or to the codes provided by memory 38. It should be noted that, for clarity, it has been omitted to show a third input of selector 44, directly connected to bus 32 and enabling passing through circuit 22 when the input image color coding must not be changed.

According to the embodiment of FIG. 3, address calculator 40 includes an address generator (GEN) 46 provided to generate and provide an address to selector 42 and to memory 38. Calculator 40 also includes a code comparison circuit (COMP) 47 provided to compare the codes received on bus 32 with the codes provided by memory 36, and to provide memory 38 with a write order when the difference between the compared codes fulfils predetermined conditions. It should be noted that memory 36 is connected so that its content can be modified by CPU 8.

The conversion circuit 22 is provided to operate in several modes. Selectors 42 and 44, as well as address calculator 40, are connected to be controlled by CPU 8 according to the operating modes of circuit 22. The connections existing between the CPU and the elements of conversion circuit 22 are within the abilities of those skilled in the art and will not be detailed any further.

According to its operating mode, circuit 22 of the present invention provides complete codes such as RGB codes or reduced codes such as CLUT codes.

Figure 4A:
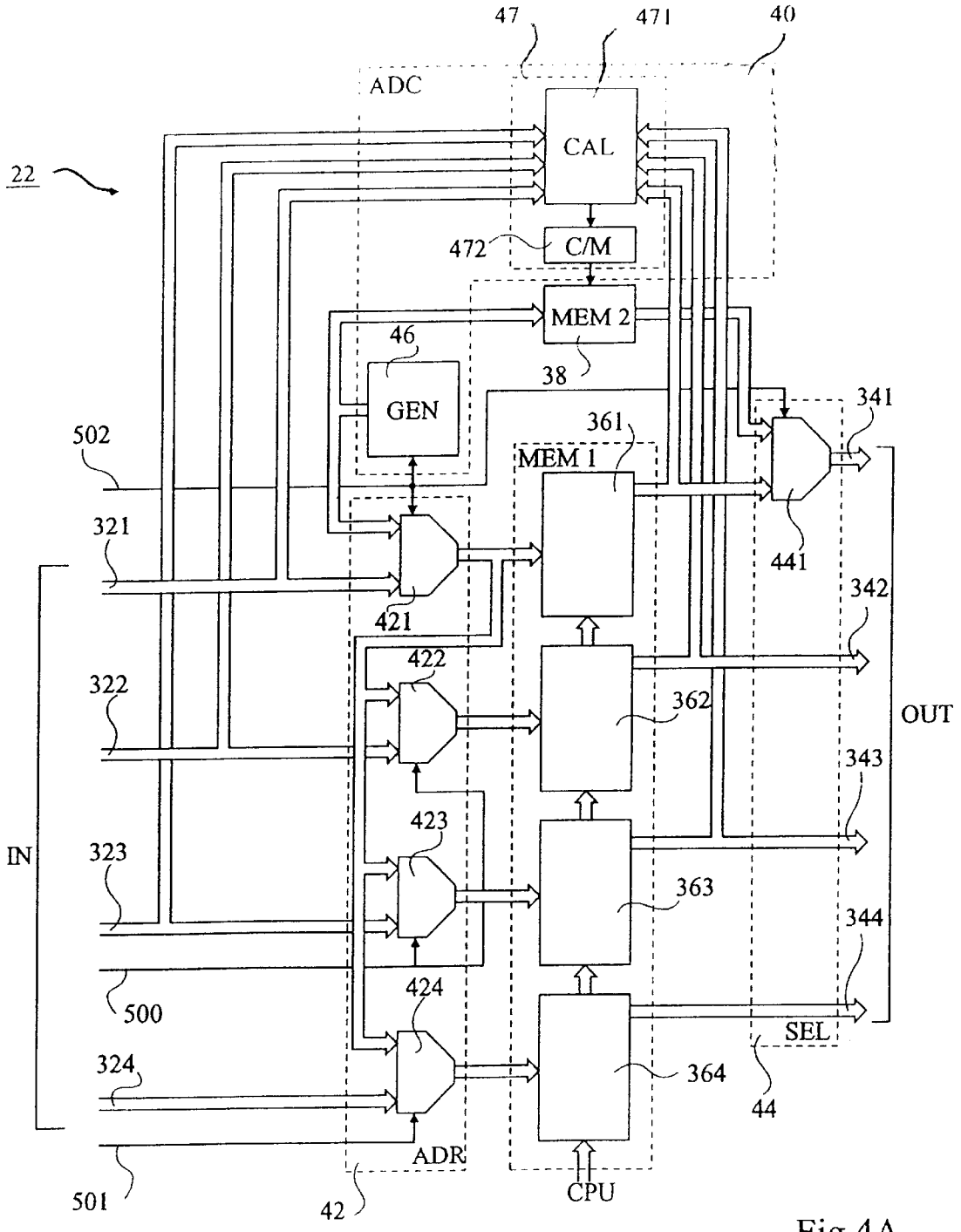
FIG. 4A shows, in the form of blocks and in more detail than in FIG. 3, an embodiment of a color converter according to the present invention.

FIG. 4A shows in more detail an embodiment of circuit 22 of FIG. 3. This circuit is provided to receive or provide color data coded, for example, over 32 bits in a format called RGBA, including three R, G, and B components each coded over 8 bits and a transparency component A coded over 8 bits. It should be noted that this circuit can also receive or provide color data coded in RGB over 24 bits, including three R, G, B components coded over 8 bits each. In such a case, the preceding component A will simply be ignored. Circuit 22 can further receive or provide color data in the form of an 8-bit CLUT code corresponding to an address in a look-up table of 256 colors.

According to the embodiment of FIG. 4A, input bus 32 includes four 8-bit sub-buses 321 to 324. Selector 42 includes four multiplexers 421 to 424 respectively receiving, on a first input, sub-buses 321 to 324. Memory 36 includes four memory circuits 361 to 364, each having 256 memory locations of 8 bits, located by an address between 0 and 255. The addressing inputs of memory circuits 361 to 364, over 8 bits, are respectively connected to the outputs of multiplexers 421 to 424. Output bus 34 includes four 8-bit sub-buses 341 to 344. Selector 44 includes a multiplexer 441, a first input of which is connected to the output of memory circuit 361, and the output of which is connected to sub-bus 341. Sub-buses 342 to 344 are respectively connected to the outputs of memory circuits 362 to 364. The output of multiplexer 421 is connected to the second inputs of multiplexers 422 to 424. Address generator 46 is a counter adapted to provide a predetermined series of address codes over 8 bits to the second input of multiplexer 421 as well as to the input of memory 38. Memory 38 includes a single 8-bit memory location. The output of memory 38 is connected to the second input of multiplexer 441.

Comparison circuit 47 includes a calculator (CAL) 471 having first, second, and third inputs respectively connected to sub-buses 321, 322, and 323, and fourth, fifth, and sixth inputs respectively connected to the outputs of the three memory circuits 361, 362 and 363. Calculator 471 is provided to provide a so-called "difference" digital signal equal to the sum of the absolute values of the differences, respectively of the codes received on the first and the fourth inputs, on the second and the fifth inputs, and on the third and the sixth inputs. Comparison circuit 47 further includes a memory comparator (C/M) 472 connected to store the smallest difference signal among the difference signals calculated by calculator 471 for the predetermined series of address codes. Comparator 472 is further connected, when it stores this difference signal, to control memory 38 to store the code of the address provided by counter 46. A first control terminal 500 is connected to the input selection terminals of multiplexers 422 and 423. A second control terminal 501 is connected to the input selection terminal of multiplexer 424. Finally, a third control terminal 502 is connected to the input selection terminals of multiplexers 421 and 441, as well as to a control terminal of counter 46. These three control terminals are conventionally connected, for example, to a CPU control register. Memory circuits 361 to 364 are also connected so that the CPU can change their content.

FIGS. 4B to 4E show with same references the elements of the circuit of FIG. 4 in different operating modes taken as an example. To ease the reading of these drawings, the unused elements in each of the modes are hatched.

Figure 4B:
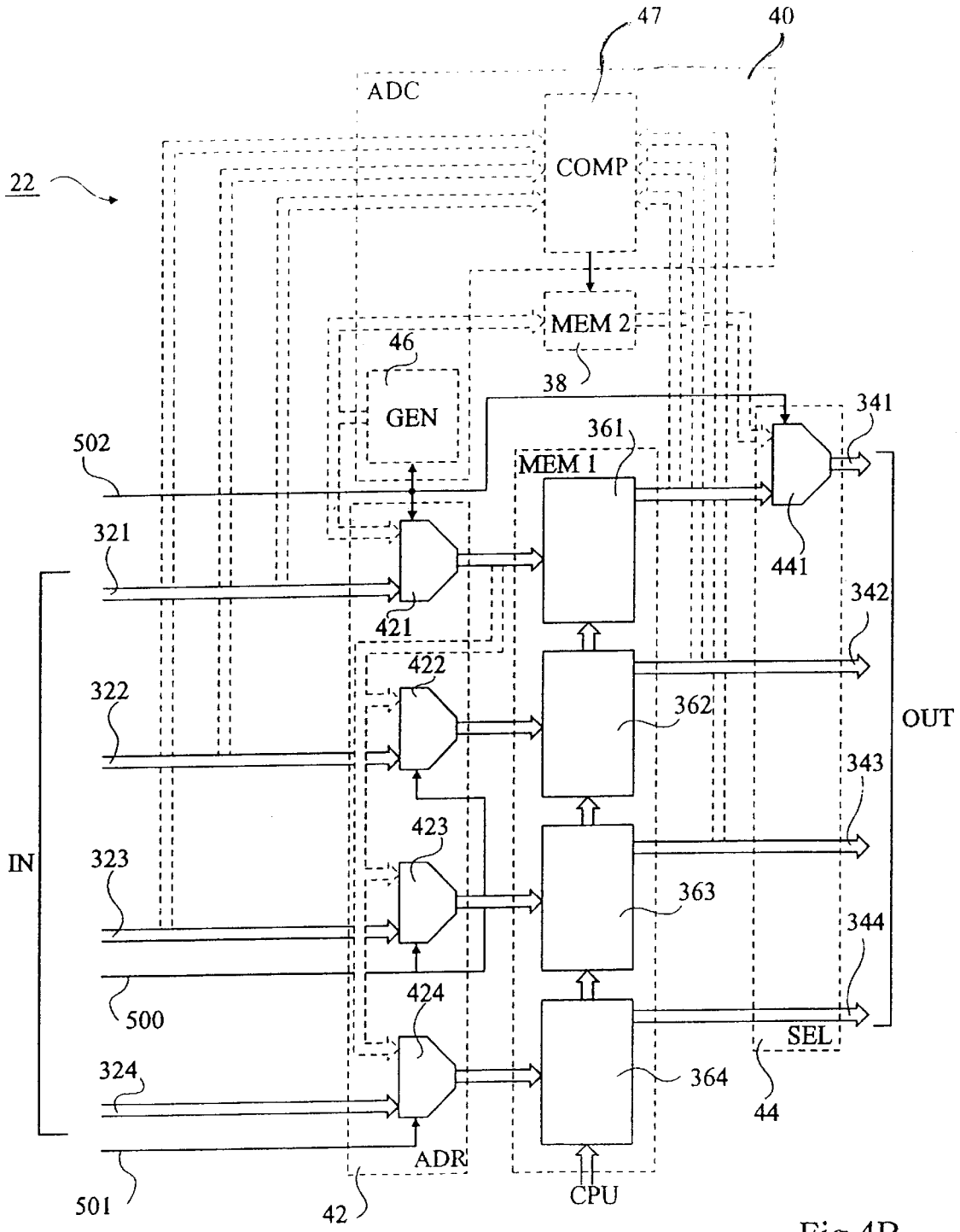
FIGS. 4B, 4C, 4D and 4E show the converter of FIG. 4A respectively in four operating modes.

FIG. 4B shows the circuit of FIG. 4 in a first so-called color transposition operating mode, where the color codes are modified, but the nature of the coding is unchanged. Sub-buses 321 to 323 respectively receive R, G, B components coded over 8 bits of a pixel and sub-bus 324 receives a transparency component A coded over 8 bits of this same pixel. Multiplexers 421 to 424 are controlled to provide memory circuits 361 to 364 with the codes received on sub-buses 321 to 324. The R, G, B, and A components are thus directly used as addresses by each of circuits 361 to 364. Output selector 44 is controlled so that the code provided by circuit 361 is provided to sub-bus 341. Thus, the codes provided to each of sub-buses 341 to 344 are the codes provided by respective circuits 361 to 364. Memory circuits 361 to 364 are respectively loaded with 256 R, G, B, and A components coded over 8 bits each, which form a color and transparency look-up table.

Such an operating mode enables submitting the images to a so-called γ (gamma) color correction. By their geometry, some cathode-ray tubes are known to modify some colors upon image display. This modification varies according to the colors and to the tube geometry. The γ correction consists of replacing an original color, of which it is known that it will be modified upon display, with a close color that, modified upon display by the tube, will correspond to the original color.

Conventionally, the γ correction is performed by the display device, generally analogically. A disadvantage is that the entire image to be displayed undergoes the correction, even if this image is formed of several sub-images, some of which require no correction. Indeed, according to their origin, some images received by the blitter may already have undergone a γ correction, for example, according to the Internet web site from which they are loaded.

The blitter of the present invention enables matching the γ correction level of the generated images. It is indeed possible to store, in memory 36, a color table including a γ correction or possibly an inverse y correction table, according to whether it is desired to generate at the output of the blitter an image including or not a γ correction, from images already including a γ correction or not. It should be noted that the selection of the operating mode can be modified so that it is possible to assign the γ correction to portions only of the compound image.

Figure 4C:
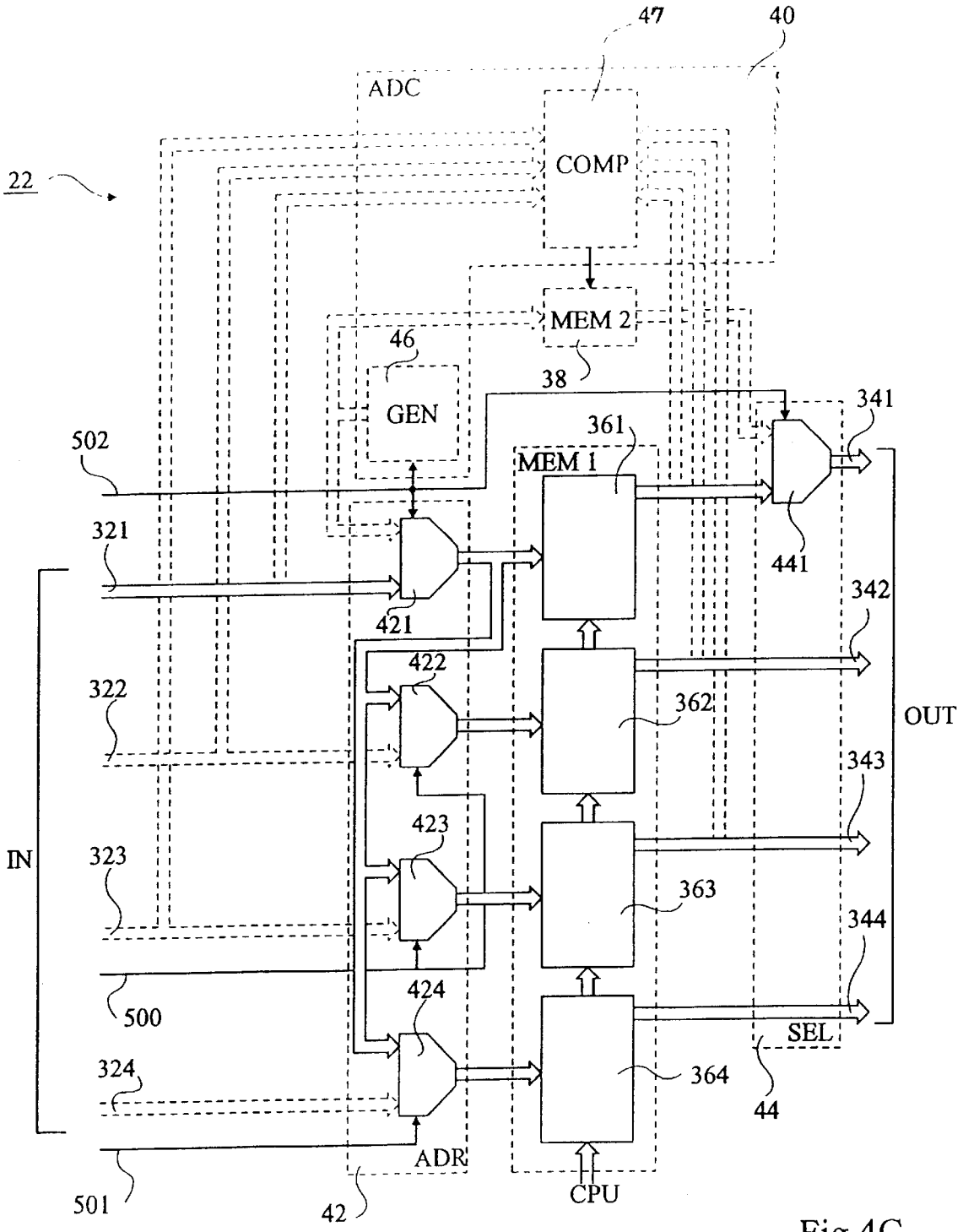

FIG. 4C shows the circuit of FIG. 4 in a second operating mode of conversion of an image in reduced code into an image in complete code. Multiplexers 422 to 424 are controlled to provide the codes received on their second inputs, and multiplexer 421 is controlled to provide as an output the codes received on its first input. Thus, in this mode, memory circuits 361 to 364 receive as an address the 8 code bits received on sub-bus 321. Also, multiplexer 441 is controlled so that sub-bus 341 is connected to the output of memory circuit 361, whereby output sub-buses 341 to 344 respectively receive the outputs of memory circuits 361 to 364. Memory circuits 361 to 364 are respectively loaded with 256 R, G, B, and A components coded over 8 bits each, which form a color and transparency look-up table. In this operating mode, an 8-bit CLUT code is provided to sub-bus 321, and the circuit associates therewith an RGBA color code coded over 32 bits. This operating mode corresponds, for example, to a conventional CLUT/RGBA conversion. It should be noted that, according to the present invention, the colors of the color look-up table can be modified to integrate γ correction functions such as previously described.

Figure 4D:
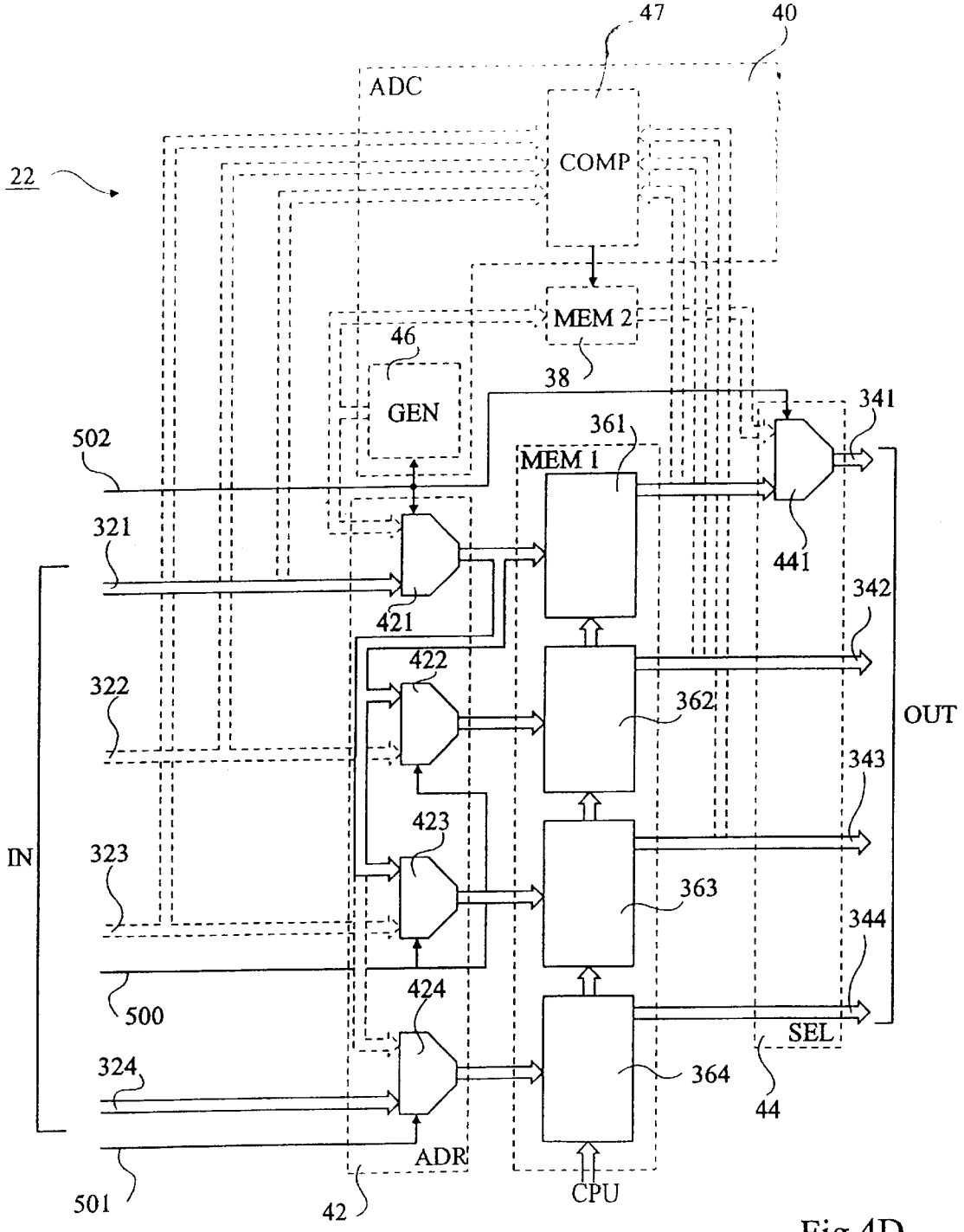

FIG. 4D shows the circuit of FIG. 4A in an alternative of the second operating mode of FIG. 4C. The only difference is that multiplexer 424 is controlled to provide memory circuit 364 with the codes received on sub-bus 324. Thereby, to an 8-bit CLUT code received on sub-bus 321 is associated an RGB color code coded over 24 bits, and to a transparency information A received on sub-bus 324 is associated a transparency information coded over eight bits provided on sub-bus 344. This alternative enables, for example, using a transparency look-up table including a reduced number of values that will receive a component A having a reduced number of bits, for example, 4 bits, and which will provide a transparency component coded over 8 bits to sub-bus 344.

Figure 4E:
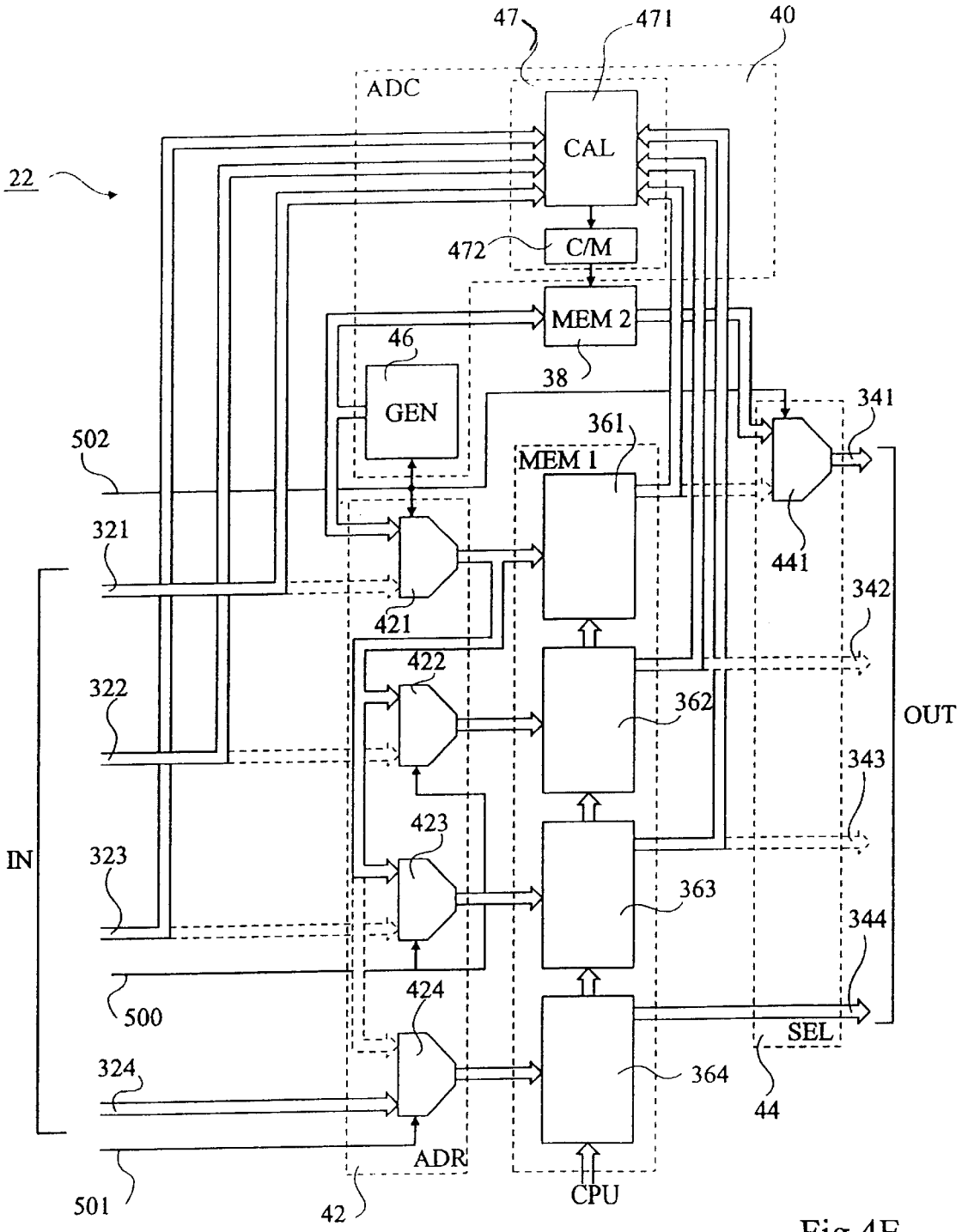

FIG. 4E shows the circuit of FIG. 4A in a fourth operating mode of conversion of an image in complete code into an image in reduced code. In this mode, multiplexers 421 to 424 are controlled to provide memory circuits 361 to 364 with the codes received on their second respective inputs. For each pixel, counter 46 is controlled to successively generate 256 codes corresponding to addresses 0 to 255. These address codes are provided to circuits 361 to 364 via multiplexers 421 to 424, as well as to memory 38. Thus, for each pixel, each circuit 361 to 364 successively provides the codes contained in its 256 memory locations.

Calculator 471 calculates the differences between the codes received on the input sub-buses and the codes provided by circuits 361 to 364 as a response to the 256 address codes generated by counter 46.

First, comparator 472 stores the difference calculated for the first address code (0) provided by counter 46. Then, each time the difference between the codes received on the input bus and the codes provided by memory 36 is smaller than this first stored difference, comparator 472 provides a write signal to memory 38. Memory 38 also receives the 256 address codes provided to memory 36. The code of the address at which is stored, in circuits 361 to 364, the color having the closest code to the color code received on bus 32, is thus memorized. In this operating mode, multiplexer 441 is controlled to provide output sub-bus 341 with the address provided by memory 38.

This operating mode enables, for example, associating with a color coded in RGB over 24 bits an 8-bit CLUT code associated with a color look-up table stored in memory 36.

It should be noted that although the data stored in circuits 361 to 364 always are 8-bit codes, respectively of red, green, and blue colors and transparency, these data can vary according to the operating modes. The present invention provides that the content of memory 36 can be changed between each operating mode.

It should be noted that the conversion circuit of FIG. 4A can be used in other embodiments than those described in relation with FIGS. 4B to 4E to convert images having color codes different from those described, for example, RGB codings using less than 24 bits.

Of course, the present invention is likely to have various alterations, modifications, and improvement which will readily occur to those skilled in the art. In particular, FIG. 4 describes an embodiment using multiplexers, but other embodiments using equivalent elements may be used. Also, those skilled in the art will easily adapt the blitter according to the present invention so that it accepts other data formats. As an example, a circuit for converting an RGB coding into another conventional coding, for example, a so-called "YcbCr" coding, and conversely, may be added to the previously-described conversion circuit.

Such alterations, modifications, and improvements are intended to be part of this disclosure, and are intended to be within the spirit and the scope of the present invention. Accordingly, the foregoing description is by way of example only and is not intended to be limiting. The present invention is limited only as defined in the following claims and the equivalents thereto.

What is claimed is:

1. A digital image processing circuit that replaces an input code associated with a pixel of a digital image with an output code selected in first storage means containing a set of codes, comprising:

an input bus that receives the input code;

an output bus that provides the output code;

said first storage means;

means of address calculation of the first storage means;

means of address selection of the first storage means between the input code and an address code generated by the address calculation means;

second storage means that contains an address code generated by the address calculation means; and means of selection of the output code between a code read at a current address of the first storage means and said code contained in the second storage means.

2. The digital image processing circuit of claim 1, wherein the address calculation means include:

an address generator that provides predetermined address codes to the means of address selection; and a data comparison circuit provided to:

compare the input code with the codes stored in the first storage means, determine which of the compared codes is closest to the first code, and control the second storage means to store the code of an address at which the closest compared code is stored in the first storage means.

3. The digital image processing circuit of claim 2, wherein:

the input and output buses each include first, second, third, and fourth sub-buses each having a same number of bits;

the address selection means include first, second, third, and fourth multiplexers having respective first inputs that are respectively connected to the first, second, third, and fourth input sub-buses, the first multiplexer having an output connected to second inputs of the second, third, and fourth multiplexers;

the first storage means include first, second, third, and fourth identical memory circuits having addressing inputs that are respectively connected to outputs of the first, second, third, and fourth multiplexers; and the output code selection means include a fifth multiplexer having a first input that is connected to a data output of the first memory circuit and an output that is connected to the first output sub-bus, the second, third, and fourth output sub-buses being respectively connected to data outputs of the second, third, and fourth memory circuits.

4. The digital image processing circuit of claim 3, wherein:

the address generator is formed with a counter that provides a predetermined series of address codes to a second input of the first multiplexer; and the data comparison circuit includes:

a calculator connected for respectively receiving codes provided to the first, second, and third input sub-buses and codes provided by the first, second, and third memory circuits, and provided to provide a digital signal equal to a difference between these codes; and a memory comparator connected for keeping a smallest difference calculated for the predetermined series of address codes and for controlling the second storage means to store a code of an address at which codes corresponding to the smallest difference are stored in the first storage means.

5. A method of image processing using the circuit of claim 4, including the steps of:

storing in the first, second, third, and fourth memory circuits respective red, green, and blue color and transparency codes, providing the first, second, and third input sub-buses with respective red, green and blue color codes, activating the counter, and controlling the multiplexers of the address selection means and of the output selection means to provide the first three memory circuits with the address codes provided by the counter, and to provide the first output sub-bus with the address code provided by the second storage means.

6. A method of image processing using the circuit of claim 3, including the steps of:

storing, in the first, second, third, and fourth memory circuits, respective red, green, and blue color and transparency codes, providing red, green, blue, and transparency codes to the first, second, third, and fourth input sub-buses, respectively, and controlling the multiplexers of the address selection means and of the output selection means to provide the first, second, third, and fourth memory circuits with the codes received on the first, second, third, and fourth input sub-buses, and to provide the four output sub-buses with the respective codes provided to the four memory circuits.

7. A method of image processing using the circuit of claim 3, including the steps of:

storing, in the first, second, third, and fourth memory circuits, respective red, green, blue, and transparency codes, providing an address code to the first input sub-bus, and controlling the multiplexers of the address selection means and of the output selection means to provide the first, second, third and fourth memory circuits with the code received on the first input sub-bus, and to provide the four output sub-buses with the respective codes provided to the four memory circuits.

8. A method of image processing using the circuit of claim 3, including the steps of:

storing in the first, second, third and fourth memory circuits respective red, green, blue, and transparency codes, providing an address code to the first input sub-bus, providing a transparency code to the fourth input sub-bus, and controlling the multiplexers of the address selection means and of the output selection means to provide the first, second, and third memory circuits with the code received on the first input sub-bus, to provide the fourth memory circuit with the code received on the fourth input sub-bus, and to provide the four output sub-buses with the respective codes provided by the four memory circuits.

9. A method of image processing using the circuit of claim 2 wherein the digital image includes pixels with colors that are coded in a predetermined way, the method comprising replacing the code of each color of the image with an address in a color reference table.

10. A method of image processing using the circuit of claim 1 wherein the input color code corresponds to an address in a color reference table stored in said first storage means, the method comprising replacing the input code with a color code designated by the address in the reference table corresponding to the input color code.

11. A digital image processing circuit, comprising:

an image source that provides a digital input image that includes a plurality of pixels;

a display device that displays digital images and has an input;

a controller coupled to the image source and display device; and a blitter coupled to the image source and display device, the blitter being structured to receive the input image from the image source, convert the input image into an output image, and transfer the output image to the display device for display of the output image, the blitter including:

a converter that converts the pixels of the input image into corresponding pixels of the output image; and a blitter core coupled to the converter and structured to group the pixels of the output image into a plurality of blocks of pixels and transmit the blocks of pixels to the display device, wherein the converter includes:

an input bus coupled to the image source to receive the input image;

a first memory that stores a set of pixel codes capable of being displayed by the display device, the first memory having an address input and an output;

an address generator that generates an address for accessing a pixel code stored in the first memory, the address generator having an address output;

an address selector having a first input coupled to the input bus, a second input coupled to the address output of the address generator, and an output coupled to the address input of the first memory, the address selector being structured to selectively couple the first and second inputs to the address input of the first memory so as to apply to the address input of the first memory either the address generated by the address generator or one of the pixels of the input image;

an output bus coupled to the display device to provide the output image to the display device;

a second memory having an input and an output, the input of the second memory being coupled to the address output of the address generator; and an output selector having a first input coupled to the output of the first memory, a second input coupled to the output of the second memory, and an output coupled to the output bus, the output selector being structured to selectively couple either the first or the second input to the output bus.

12. The digital image processing circuit of claim 11 wherein the pixel codes stored in the first memory are γ-corrected codes and, in a γ-correction mode, the controller causes the address selector to couple the first input to the address input of the first memory such that a selected pixel of the input image is used to address a corresponding one of the γ-corrected codes in the first memory, thereby causing the corresponding γ-corrected code to replace the selected pixel in the output image.

13. The digital image processing circuit of claim 11 wherein the pixels of the input image are represented by color codes of a first color coding scheme and the pixel codes stored in the first memory are color codes of a second color coding scheme, and, in a code transformation mode, the controller causes the address selector to couple the first input to the address input of the first memory such that a selected pixel of the input image is used to address a corresponding one of the color codes in the first memory, thereby causing the corresponding color code to replace the selected pixel in the output image.

14. A digital image processing circuit, comprising:

an image source that provides a digital input image that includes a plurality of pixels;

a display device that displays digital images and has an input;

a controller coupled to the image source and display device; and a blitter coupled to the image source and display device, the blitter being structured to receive the input image from the image source, convert the input image into an output image, and transfer the output image to the display device for display of the output image, the blitter including:

a converter that converts the pixels of the input image into corresponding pixels of the output image; and a blitter core coupled to the converter and structured to group the pixels of the output image into a plurality of blocks of pixels and transmit the blocks of pixels to the display device, wherein the converter includes:

an input bus coupled to the image source to receive the input image;

a first memory that stores a set of pixel codes capable of being displayed by the display device, the first memory having an address input and an output;

an address generator that generates an address for accessing a pixel code stored in the first memory, the address generator having an address output; and an address selector having a first input coupled to the input bus, a second input coupled to the address output of the address generator, and an output coupled to the address input of the first memory, the address selector being structured to selectively couple the first and second inputs to the address input of the first memory so as to apply to the address input of the first memory either the address generated by the address generator or one of the pixels of the input images, wherein the pixels of the input image are represented by color codes of a first color coding scheme and the pixel codes stored in the first memory are color codes of a second color coding scheme, and, in a code transformation mode, the controller causes the address selector to couple the first input to the address input of the first memory such that a selected pixel of the input image is used to address a corresponding one of the color codes in the first memory, thereby causing the corresponding color code to replace the selected pixel in the output image, wherein the converter further includes:

an output bus coupled to the display device to provide the output image to the display device;

a second memory having an address input coupled to the address output of the address generator, a control input, and an output coupled to the output bus; and a data comparison circuit having a first input coupled to the input bus to receive the input image, a second input coupled to the output of the first memory, and a control output coupled to the control input of the second memory, the data comparison circuit being structured to compare a pixel of the input image with pixel codes in the first memory that are accessed by addresses generated by the address generator, determine which pixel code most closely matches the pixel of the input image, and cause the second memory to store the address of the pixel code that most closely matches the input image.

15. A digital image processing circuit, comprising:

an image source that provides a digital input image that includes a plurality of pixels;

a display device that displays digital images and has an input;

a controller coupled to the image source and display device; and a blitter coupled to the image source and display device, the blitter being structured to receive the input image from the image source, convert the input image into an output image, and transfer the output image to the display device for display of the output image, the blitter including:

a converter that converts the pixels of the input image into corresponding pixels of the output image; and a blitter core coupled to the converter and structured to group the pixels of the output image into a plurality of blocks of pixels and transmit the blocks of pixels to the display device, wherein the converter includes:

an input bus coupled to the image source to receive the input image;

a first memory that stores a set of pixel codes capable of being displayed by the display device, the first memory having an address input and an output;

an address generator that generates an address for accessing a pixel code stored in the first memory, the address generator having an address output; and an address selector having a first input coupled to the input bus, a second input coupled to the address output of the address generator, and an output coupled to the address input of the first memory, the address selector being structured to selectively couple the first and second inputs to the address input of the first memory so as to apply to the address input of the first memory either the address generated by the address generator or one of the pixels of the input image, wherein:

the input and output buses each include first, second, third, and fourth sub-buses having an equal number of bits;

the address selector includes first, second, third, and fourth multiplexers having respective first inputs respectively connected to the first, second, third, and fourth input sub-buses, the first multiplexer having an output connected to respective second inputs of the second, third, and fourth multiplexers; and the first memory includes first, second, third, and fourth memory circuits having respective addressing inputs respectively connected to respective outputs of the first, second, third, and fourth multiplexers.

16. A digital image processing circuit that converts pixels of an input image into corresponding pixels of an output image, comprising:

an input bus that receives the input image;

a first memory that stores a set of pixel codes capable of being displayed by a display device, the first memory having an address input and an output;

an address generator that generates an address for accessing a pixel code stored in the first memory, the address generator having an address output;

an address selector having a first input coupled to the input bus, a second input coupled to the address output of the address generator, and an output coupled to the address input of the first memory, the address selector being structured to selectively couple the first and second inputs to the address input of the first memory so as to apply to the address input of the first memory either the address generated by the address generator or one of the pixels of the input image; and a converter, comprising:

an output bus that provides pixels of an output image to a display device;

a second memory having an address input coupled to the address output of the address generator, a control input, and an output coupled to the output bus; and a data comparison circuit having a first input coupled to the input bus to receive the input image, a second input coupled to the output of the first memory, and a control output coupled to the control input of the second memory, the data comparison circuit being structured to compare a pixel of the input image with pixel codes in the first memory that are accessed by addresses generated by the address generator, determine which pixel code most closely matches the pixel of the input image, and cause the second memory to store the address of the pixel code that most closely matches the input image.

17. The digital image processing circuit of claim 16 wherein the pixel codes stored in the first memory are γ-corrected codes and, in a y-correction mode, the controller causes the address selector to couple the first input to the address input of the first memory such that a selected pixel of the input image is used to address a corresponding one of the γ-corrected codes in the first memory, thereby causing the corresponding γ-corrected code to replace the selected pixel in the output image.

18. The digital image processing circuit of claim 16 wherein the pixels of the input image are represented by color codes of a first color coding scheme and the pixel codes stored in the first memory are color codes of a second color coding scheme, and, in a code transformation mode, the controller causes the address selector to couple the first input to the address input of the first memory such that a selected pixel of the input image is used to address a corresponding one of the color codes in the first memory, thereby causing the corresponding color code to replace the selected pixel in the output image.

19. The digital image processing circuit of claim 18 wherein:

the input and output buses each include first, second, third, and fourth sub-buses having an equal number of bits;

the address selector includes first, second, third, and fourth multiplexers having respective first inputs respectively connected to the first, second, third, and fourth input sub-buses, the first multiplexer having an output connected to respective second inputs of the second, third, and fourth multiplexers; and the first memory includes first, second, third, and fourth memory circuits having respective addressing inputs respectively connected to respective outputs of the first, second, third, and fourth multiplexers.

20. The digital image processing circuit of claim 16 wherein the converter further includes:

an output bus coupled to the display device to provide the output image to the display device;

a second memory having an input and an output, the input of the second memory being coupled to the address output of the address generator; and an output selector having a first input coupled to the output of the first memory, a second input coupled to the output of the second memory, and an output coupled to the output bus, the output selector being structured to selectively couple either the first or the second input to the output bus.

* * * * *